US011604434B2

(12) United States Patent
Jeanrenaud et al.

(10) Patent No.: US 11,604,434 B2
(45) Date of Patent: Mar. 14, 2023

(54) HOROLOGICAL CARRIAGE-STOP WITH CARRIAGE STOP STRIP

(71) Applicant: Omega SA, Biel/Bienne (CH)

(72) Inventors: Timothee Jeanrenaud, Yverdon-les-Bains (CH); Jean-Claude Monachon, Bevaix (CH)

(73) Assignee: Omega SA, Biel/Bienne (CH)

( * ) Notice: Subject to any disclaimer, the term of this patent is extended or adjusted under 35 U.S.C. 154(b) by 353 days.

(21) Appl. No.: 16/901,112

(22) Filed: Jun. 15, 2020

(65) Prior Publication Data

US 2021/0026302 A1 Jan. 28, 2021

(30) Foreign Application Priority Data

Jul. 23, 2019 (EP) ..... 19187811

(51) Int. Cl.
*G04B 17/28* (2006.01)
*G04B 13/02* (2006.01)
*G04B 15/14* (2006.01)

(52) U.S. Cl.
CPC ..... *G04B 17/285* (2013.01); *G04B 13/02* (2013.01); *G04B 15/14* (2013.01)

(58) Field of Classification Search
CPC ..... G04B 13/02; G04B 17/285; G04B 15/14; G04B 27/004; G04B 17/26; G04B 27/005; G04B 27/001; G04B 27/00
See application file for complete search history.

(56) References Cited

U.S. PATENT DOCUMENTS 7,244,062 B2 * 7/2007 Golay ..... G04B 27/004 368/142
9,897,972 B2 * 2/2018 Heise ..... G04B 27/001
(Continued)

FOREIGN PATENT DOCUMENTS

CH 698 622 B1 9/2009
CN 101093385 A 12/2007
(Continued)

OTHER PUBLICATIONS

European Search Report dated Jan. 31, 2020 in European Application 19187811.5 filed Jul. 23, 2019 (with English Translation of Categories of Cited Documents), 4 pages.
(Continued)

*Primary Examiner* — Edwin A. Leon
(74) *Attorney, Agent, or Firm* — Oblon, McClelland, Maier & Neustadt, L.L.P.

(57) ABSTRACT

A limiting device including an oscillator and capable of blocking this oscillator carried by the carriage of a tourbillon or karussel, which carriage includes a carriage wheel driven by an energy source of the watch or of a movement with a gear train, and carries an escapement mechanism engaging with the oscillator and including an escape pinion, this device includes a control rod, engaging with a control member external to this tourbillon or karussel, in order to push, substantially radially relative to the carriage axis, a resilient strip arranged so as to bear tangentially against the carriage wheel in order to stop the carriage upon passage of the control member from a rest position to an active position, and so as to remain remote from the carriage wheel when the control member is in the rest position thereof.

8 Claims, 5 Drawing Sheets

(56) References Cited

U.S. PATENT DOCUMENTS

| | | | | |
|---|---|---|---|---|
| 2004/0062149 | A1 | 4/2004 | Geyer | |
| 2010/0046329 | A1* | 2/2010 | Greubel ..... | G04B 17/285 368/171 |
| 2010/0278017 | A1 | 11/2010 | Brossard et al. | |
| 2014/0185418 | A1 | 7/2014 | Nakajima et al. | |

FOREIGN PATENT DOCUMENTS

| | | | |
|---|---|---|---|
| CN | 101720452 | A | 6/2010 |
| CN | 102998967 | A | 3/2013 |
| CN | 103492960 | A | 1/2014 |
| CN | 104570683 | A | 4/2015 |
| CN | 104737081 | A | 6/2015 |
| CN | 106483818 | A | 3/2017 |
| EP | 1 451 647 | B1 | 9/2004 |
| EP | 2 246 752 | B1 | 11/2010 |
| EP | 3 136 186 | A1 | 3/2017 |
| WO | WO 03/048871 | A2 | 6/2003 |

OTHER PUBLICATIONS

Combined Chinese Office Action and Search Report dated Jun. 23, 2021 in Chinese Patent Application No. 202010718597.9 (with English translation of Category of Cited Documents), 7 pages.

* cited by examiner

HOROLOGICAL CARRIAGE-STOP WITH CARRIAGE STOP STRIP

CROSS-REFERENCE TO RELATED APPLICATION

This application claims priority to European Patent Application No. 19187811.5 filed on Jul. 23, 2019, the entire disclosure of which is hereby incorporated herein by reference.

FIELD OF THE INVENTION

The invention relates to a horological limiting device for a watch, comprising an oscillator, and comprising means for limiting the variation of rate of this oscillator in the different positions of said watch in space, said device comprising at least one tourbillon or a karussel, which comprises a carriage which is mounted such that it pivots about a carriage axis relative to a plate, which carries a fixed wheel when said limiting device comprises a tourbillon, which carriage carries said oscillator and comprises a carriage wheel arranged so as to be driven by an energy source of the watch or of a movement by way of a gear train, and which carriage carries an escapement mechanism arranged so as to engage with said oscillator, and comprising an escape pinion meshing with said fixed wheel when said limiting device comprises a tourbillon or meshing with a third wheel or a fourth wheel, comprised in said gear train, when said limiting device comprises a karussel.

The invention further relates to a watch comprising a horological movement comprising energy storage means, an oscillator, hand-setting means, and such a limiting device comprising this oscillator.

The invention relates to the field of mechanical watches with high chronometric precision equipped with tourbillons or karussels, and so-called second-stop or carriage-stop mechanisms arranged so as to finely adjust the state of the watch.

BACKGROUND OF THE INVENTION

British patent No. 674764 filed by HEPTINSTALL discloses a spring-finger for blocking a balance.

European patent No. 1617305B1 filed by MONTRES BREGUET discloses a control for manually stopping, via the stem, pad levers for blocking a balance.

European patent No. 2787400B1 filed by CHOPARD discloses a stop element, integral with a carriage such that it rotates therewith, and which is a disc coaxial to this carriage, axially displaced for axial friction with a balance.

European patent No. 2085832B1 filed by FREDERIC PIGUET discloses a friction clutch mechanism, by radially placing clutching elements at the ends of star-shaped arms in a cylindrical surface of a driving plate, under the axial effect of a clutch spring.

SUMMARY OF THE INVENTION

The invention proposes stopping a tourbillon or karussel carriage when setting the hands so as to adjust a watch to the nearest second.

For this purpose, the invention relates to a horological limiting device for limiting the variation of rate of an oscillator comprised in a watch, according to claim 1.

The invention further relates to a watch comprising a horological movement comprising energy storage means, an oscillator, hand-setting means, and such a limiting device.

BRIEF DESCRIPTION OF THE DRAWINGS

Other features and advantages of the invention will be better understood upon reading the following detailed description given with reference to the accompanying drawings, in which:

FIG. 1 shows the rod in a rest position, wherein the strip spring is remote from the carriage wheel;

DETAILED DESCRIPTION OF THE PREFERRED EMBODIMENTS

Figure 1:
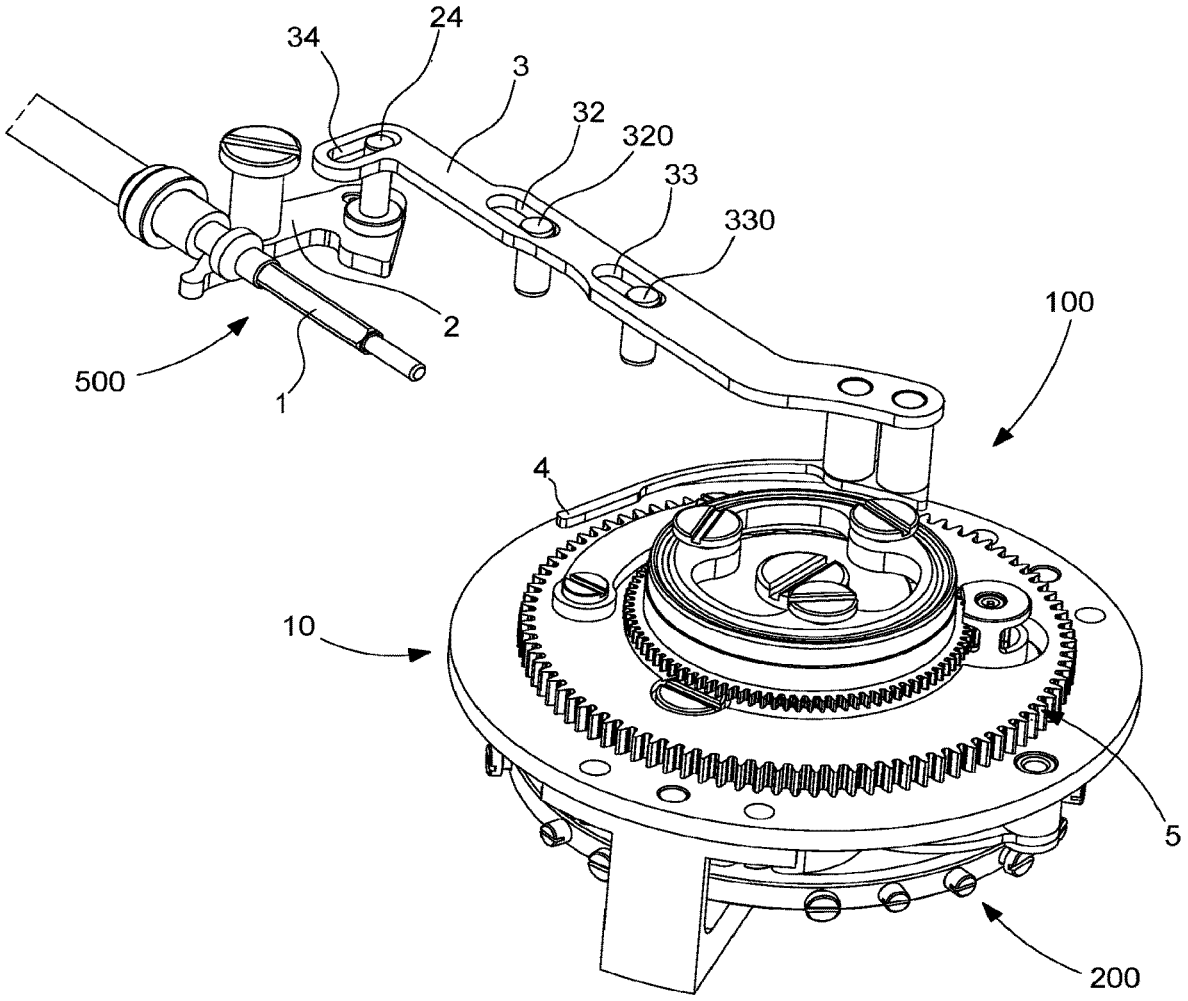
FIG. 1 diagrammatically shows a partial and perspective view of a horological limiting device for limiting the variation of rate of an oscillator, this sprung balance oscillator being carried by the carriage of a tourbillon, which carriage is integral with a carriage wheel to be driven thereby; the oscillator is pivoted between a lower carriage bridge and an upper carriage bridge; the limiting device comprises a stop mechanism, controlled by an engaging rod moved by a control member of the watch, in this case formed by a winding and setting stem; this engaging rod is arranged to radially move, relative to the carriage axis, a strip spring arranged to bear against the carriage wheel in an active position.
Figure 2:
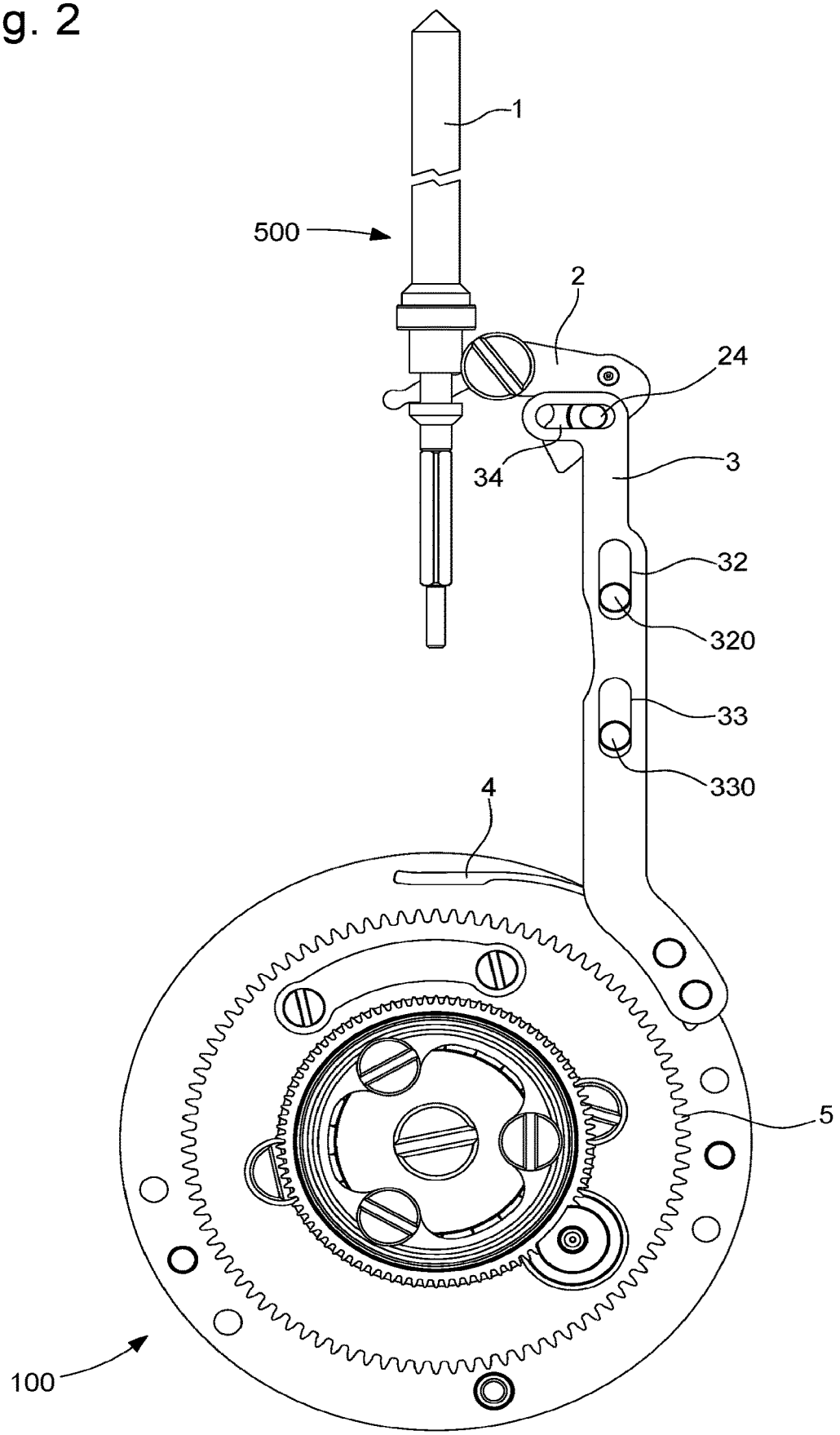
FIG. 2 shows the mechanism in FIG. 1 from below, with the rod in the same rest position.
Figure 3:
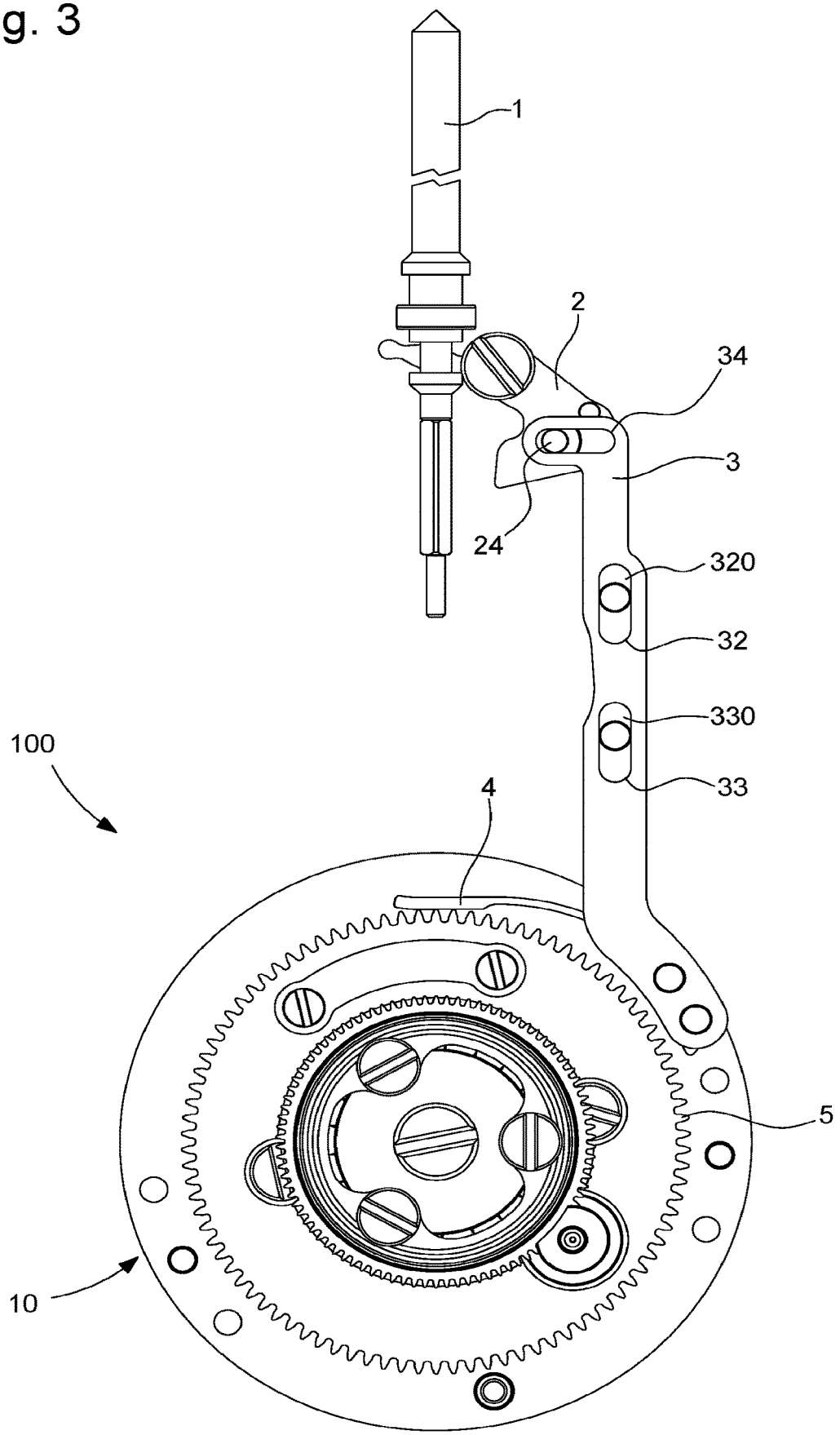
FIG. 3 diagrammatically shows, similarly to FIG. 1, the same mechanism with the control rod in an active position, with the strip spring bearing against the carriage wheel.
Figure 4:
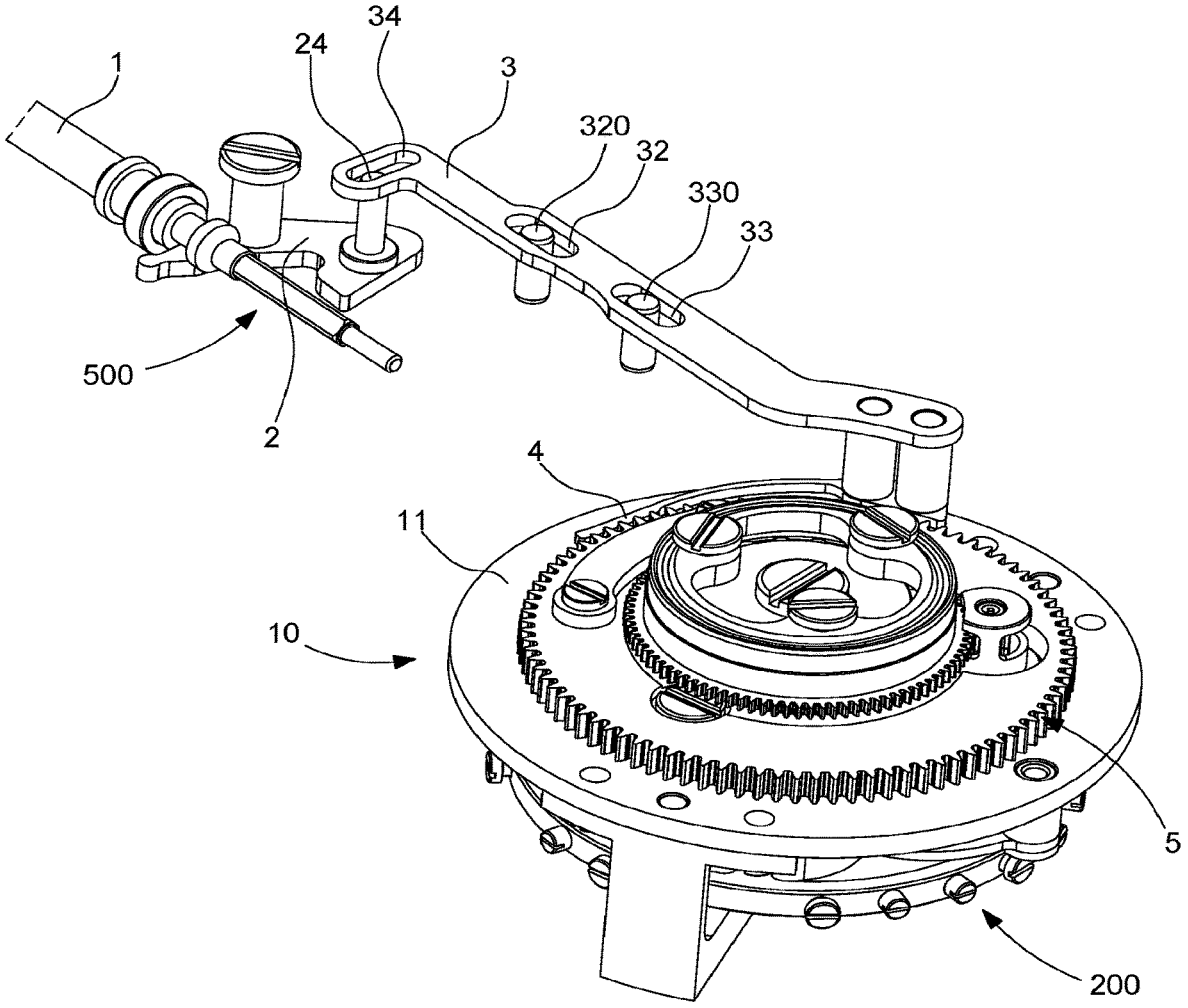
FIG. 4 diagrammatically shows, similarly to FIG. 2, the same mechanism with the control rod in an active position, with the strip spring bearing against the carriage wheel.

The invention relates to the field of mechanical watches with high chronometric performance levels.

Known methods of improving insensitivity to the positions of a watch 1000 involve equipping it with a horological limiting device 100, comprising an oscillator 200, and comprising means for limiting the variation of rate of this oscillator 200, in the different positions of the watch 1000 in space.

This device 100 comprises at least one tourbillon 300 or a karussel which, in either case, comprises a carriage 10 which is mounted such that it pivots about a carriage axis D relative to a plate 900.

This plate 900 carries a fixed wheel 210 when the limiting device 100 comprises a tourbillon 300.

The carriage 10 carries the oscillator 200, and comprises a carriage wheel 5, which is arranged so as to be driven by an energy source 400 of the watch 1000 or of a movement 800 comprised in the watch, by way of a gear train. This energy source 400 can in particular comprise at least one barrel or similar element.

The carriage 10 further carries an escapement mechanism 700, which is arranged so as to engage with the oscillator 200, and which comprises an escape pinion 201. The carriage 10 comprises a lower bridge 11 and an upper bridge 12.

The upper carriage bridge 12 protects both the oscillator 200, the escapement mechanism 700, and the mechanism according to the invention.

This escape pinion 201 meshes with the fixed wheel 210 when the limiting device 100 comprises a tourbillon, or meshes with a third wheel or a fourth wheel, comprised in the gear train, when the limiting device 100 comprises a karussel.

The mechanism according to the invention allows the karussel or tourbillon carriage to be stopped when setting the hands.

According to the invention, the device 100 comprises a control rod 30, which is arranged to engage with a control member external to the tourbillon 300 or karussel, in order to push, substantially radially relative to the carriage axis D, a resilient strip 4 which is arranged so as to bear substantially tangentially against the carriage wheel 5 in order to stop the carriage 10 upon passage of the control member from a rest position to an active position, and so as to remain remote from the carriage wheel 5 when the control member is in the rest position thereof.

More particularly, the device 100 comprises hand-setting means 500, which constitute or which control the control member, which is arranged so as to move the control rod 30 in a first activation direction upon the passage of the hand-setting means 500 from a rest position T1 to an activated position T2, and to move the control rod 30 in a second direction opposite the first direction upon the passage of the hand-setting means 500 from the activated position T2 to the rest position T1.

In an alternative embodiment, as shown in FIGS. 1 to 4, the strip spring comprises a smooth bearing surface, having a cylindrical portion, the radius whereof is the same as the outer diameter of the carriage wheel 5.

Figure 5:
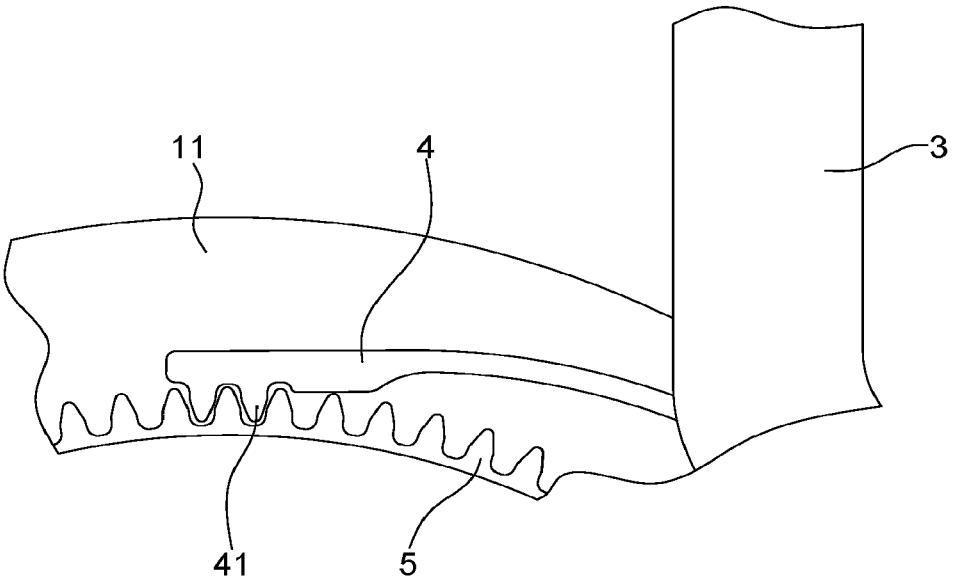
FIG. 5 diagrammatically shows a plan view of a feature of an alternative embodiment wherein the strip spring comprises a notching complementing the toothing of the carriage wheel.
Figure 6:
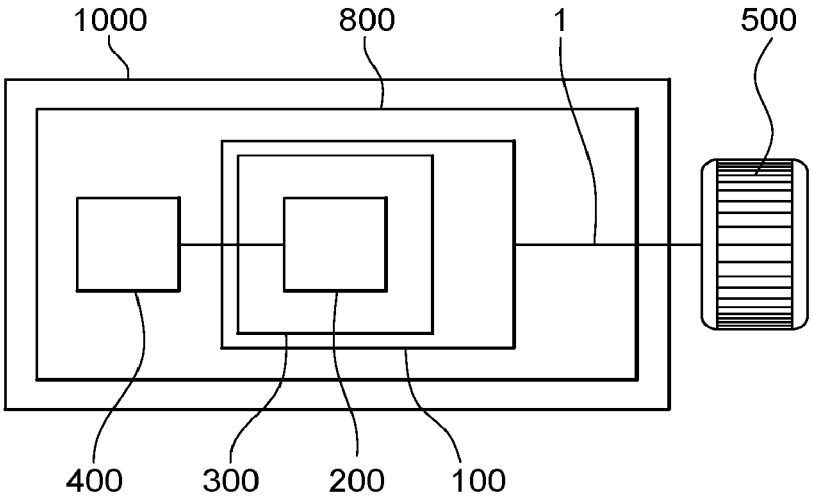
FIG. 6 is a block diagram showing a watch comprising a horological movement comprising energy storage means, an oscillator, hand-setting means, and such a limiting device.

In another alternative embodiment, as shown in FIG. 5, the resilient strip 4 comprises a toothing 41 arranged so as to engage by meshing with the toothing of the carriage wheel 5.

More particularly, the resilient strip 4 extends in the cantilever position relative to the fastening thereof on the control rod 30.

In an alternative embodiment, the resilient strip 4 has a convex surface on the carriage 10 side.

In another alternative embodiment, the resilient strip 4 has a concave surface on the carriage 10 side.

More particularly, the oscillator 200 is a sprung balance assembly.

The invention further relates to a watch 1000 comprising a horological movement 800 comprising energy storage means 400, an oscillator 200, hand-setting means 500, and such a limiting device 100.

More particularly, the tourbillon 300 or karussel constitutes a display member of the watch 1000, or is arranged so as to drive at least one display member of the watch 1000, and the hand-setting means 500 constitute or control the control member.

In the non-limiting alternative embodiment shown in the figures, hand-setting means 500 constitute or control the control member, and comprise a conventional winding and setting stem 1, and which operate as follows:

in position T1, the winding and setting stem 1 positions the pull-out piece 2, on which a large stud 24 is driven. This stud 24 is in contact with the control rod 3 via a loop 34. The control rod 3 is guided by the engagement of two pins 320 and 330 fastened to the plate 900 and two oblongs 32 and 33 comprised in the rod 3, in order to move in a linear manner. It carries a strip spring 4 which lies in the same plane as the carriage wheel 5. This carriage wheel 5 is integral with the carriage 10. The system is fixed in the position below in T1;

when passing from T1 to T2, the winding and setting stem 1 causes the pull-out piece 2 to pivot, which itself lowers the control rod 3 towards the carriage 10. The strip spring 4 then comes into contact with the toothing of the carriage wheel 5, which causes the carriage to stop.

The system is designed to stop the tourbillon, or respectively the karussel, when setting the hands.

The system rests against the carriage wheel with a strip spring which exerts sufficient pressure to stop the carriage.

To summarise, the invention allows:

a tourbillon or karussel carriage to be instantly stopped; the time to be set to the nearest second.

This mechanism with integrated stop wheel is compact, the manufacture thereof requires conventional technology and the cost thereof is thus low.

The invention claimed is:

1. A horological limiting device for a watch, comprising an oscillator, and comprising means for limiting a variation of rate of said oscillator in different positions of said watch in space, said device comprising:

at least one tourbillon or a carousel, said tourbillon or said carousel comprising a carriage mounted to pivot about a carriage axis relative to a plate carrying a fixed wheel when said limiting device comprises said tourbillon, wherein said carriage carries said oscillator and comprises a carriage wheel arranged so as to be driven by an energy source of the watch or of a movement with a gear train, and wherein said carriage carries an escapement mechanism arranged so as to engage with said oscillator, and comprising an escape pinion meshing with said fixed wheel when said limiting device comprises a tourbillon or meshing with a third wheel or a fourth wheel, comprised in said gear train, when said limiting device comprises said carousel, wherein said device comprises a control rod arranged to engage with a control member external to said tourbillon or carousel, in order to push, substantially radially relative to said carriage axis, a resilient strip which is arranged so as to bear substantially tangentially against said carriage wheel in order to stop said carriage upon passage of said control member from a rest position to an active position, and so as to remain remote from said carriage wheel when said control member is in said rest position thereof.

2. The limiting device according to claim 1, wherein said device comprises hand-setting means that comprise or control said control member, said control member being arranged so as to move said control rod in a first activation direction upon the passage of said hand-setting means from a rest position T1 to an activated position T2, and to move said control rod in a second direction opposite said first direction upon the passage of said hand-setting means from said activated position T2 to said rest position T1.

3. The limiting device according to claim 1, wherein said resilient strip comprises a toothing arranged so as to engage by meshing with the toothing of said carriage wheel.

4. The limiting device according to claim 1, wherein said resilient strip extends in a cantilever position relative to the fastening thereof on said control rod.

5. The limiting device according to claim 1, wherein said resilient strip has a convex surface on said carriage side.

6. The limiting device according to claim 1, wherein said resilient strip has a concave surface on said carriage side.

7. The limiting device according to claim 1, wherein said oscillator is a sprung balance assembly.

8. A watch comprising:

a horological movement comprising energy storage means, hand-setting means, and a limiting device comprising an oscillator, said limiting device comprising means for limiting a variation of rate of said oscillator in different positions of said watch in space, said device comprising at least one tourbillon or a carousel, said tourbillon or said carousel comprising a carriage mounted to pivot about a carriage axis relative to a plate carrying a fixed wheel when said limiting device comprises said tourbillon, wherein said carriage carries said oscillator and comprises a carriage wheel arranged so as to be driven by an energy source of the watch or of a movement with a gear train, wherein said carriage carries an escapement mechanism arranged so as to engage with said oscillator, and comprising an escape pinion meshing with said fixed wheel when said limiting device comprises a tourbillon or meshing with a third wheel or a fourth wheel, comprised in said gear train, when said limiting device comprises said carousel, wherein said device comprises a control rod arranged to engage with a control member external to said tourbillon or carousel, in order to push, substantially radially relative to said carriage axis, a resilient strip which is arranged so as to bear substantially tangentially against said carriage wheel in order to stop said carriage upon passage of said control member from a rest position to an active position, and so as to remain remote from said carriage wheel when said control member is in said rest position thereof, and wherein said tourbillon or carousel constitutes a display member of said watch, or is arranged so as to drive at least one display member of said watch, and wherein said hand-setting means comprise or control said control member.

* * * * *